United States Patent [19]

Baker et al.

[11] Patent Number: 4,773,145

[45] Date of Patent: Sep. 27, 1988

[54] METHOD OF CONSTRUCTING A CYLINDRICAL ROTOR ASSEMBLY FOR A ROTARY REGENERATIVE HEAT EXCHANGER

[75] Inventors: Roderick J. Baker, Belmont; James A. Groves, Wellsville, both of N.Y.; Peter Hallam, Markham; John E. Irving, Agincourt, both of Canada

[73] Assignee: The Air Preheater Company, Inc., Wellsville, N.Y.

[21] Appl. No.: 531,146

[22] Filed: Sep. 9, 1983

[51] Int. Cl.[4] ..... B23P 15/26

[52] U.S. Cl. ..... 29/157.3 R; 29/426.2; 29/426.3; 165/8

[58] Field of Search ..... 165/8; 29/157.3 AH, 29/157.3 R, 426.3, 426.2

[56] References Cited

U.S. PATENT DOCUMENTS

| | | | |
|---|---|---|---|
| 3,267,562 | 8/1966 | Chiang et al. | 29/157.3 R |
| 3,789,916 | 2/1974 | Lindahl | 165/8 |
| 3,891,029 | 6/1975 | Mahoney | 165/8 |

*Primary Examiner*—P. W. Echols

*Attorney, Agent, or Firm*—William W. Habelt

[57] ABSTRACT

A method of constructing a rotor assembly (12) for a rotary regenerative heat exchanger wherein the rotor compartment (14) is formed of a plurality of prefabricated, shop-assembled subcompartments (20) which are shipped disassembled from the central rotor post (16) for final erection in the field. The method of the present invention maximizes shop welding in the horizontal downhand position and minimizes welding in the vertical up position both in the shop and in the field.

3 Claims, 3 Drawing Sheets

METHOD OF CONSTRUCTING A CYLINDRICAL ROTOR ASSEMBLY FOR A ROTARY REGENERATIVE HEAT EXCHANGER

BACKGROUND OF THE INVENTION

The invention relates to rotary regenerative heat exchangers and, more particularly, to a method of constructing a cylindrical rotor assembly for a rotary regenerative heat exchanger of the type wherein the rotor is mounted about a rotor post that is disposed along a vertical axis.

Conventional rotary regenerative heat exchangers are comprised of a rotor assembly which is surrounded by a housing having end plates formed with openings arranged to direct the flow of a heating gas and a gas to be heated through the housing to transverse the rotor assembly disposed therein. The rotor assembly is formed of a rotor compartment surrounding and mounted to a rotatable central rotor post. The rotor compartment is formed of a plurality of sectors defined by radial partitions, termed diaphragms, mounted to and extending radially outward from the rotor post. Each of these sector compartments carries heat absorbent material in the form of metallic plates which are first positioned in the heating gas stream to absorb heat therefrom and then moved, as the rotor rotates, into the stream of gas to be heated to transfer the absorbed heat thereto.

Typically, such a rotary regenerative heat exchanger is of such a size to preclude it being shipped from the manufactured plant to the erection site as a complete unit. Therefore, it has become customary to manufacture the rotor assembly in subsections which may readily be shipped, typically by truck, rail or barge, to the erection site where the complete heat exchanger is assembled. One method of manufacturing such a rotor assembly in sections for subsequent field erection is disclosed in U.S. Pat. No. 3,267,562 of Chiang et al. As disclosed therein, a plurality of individual sector compartments are prefabricated in the shop and then shipped with the rotor post to the field for erection. The rotor post comprises a cylindrical post having a plurality of circumferentially spaced axially elongated rib plates extending radially therefrom to which the sector compartments are bolted and welded when the heat exchanger is constructed in the field. Each of the prefabricated sector compartments comprises at least a pair of diaphragm plates interconnected by transverse support members. The rib plates extending from the rotor post comprise axially elongated plates of structural steel which are welded to the rotor post along a vertical seam.

An alternate method of constructing a vertical rotary regenerative heat exchanger is disclosed in U.S. Pat. No. 3,891,029 of Mahoney. As disclosed therein, the rotor assembly is again constructed in the field from a plurality of individual prefabricated sector compartments which in this case are each adapted to be secured to the rotor post only by a pin connection at the upper end and the lower end of the rotor post. Each of the individual sector compartments comprises a pair of radially extending diaphragm plates interconnected by transverse structural grid members. The rotor assembly is typically comprised of up to 24 of such prefabricated sector compartments. To erect the heat exchanger in the field, each of the individual sector compartments is pinned to the rotor post at the top and at the bottom of the rotor post and then the diaphragm plates of juxtadisposed sector compartments are bolted together. Thus, at the interface of each of the sector compartments there are double diaphragms. Although such a design has eliminated the welding of the rib plates to the rotor post as a means of supporting the sector compartments, the use of double diaphragms at the interface of each of the sector compartments adds structural weight and cost to the manufacture of the rotor assembly.

SUMMARY OF THE INVENTION

In accordance with the present invention, there is provided a method of constructing a rotor assembly for a rotary regenerative heat exchanger wherein the rotor compartment is formed of a plurality of independent subcompartments which are prefabricated and then shipped disassembled from the rotor post for final erection in the field.

In accordance with the present invention, each sector shaped rotor subcompartment is formed by first detachably mounting to the central rotor post a sector-shaped upper support lug at the top thereof and a sector-shaped lower support lug at the bottom thereof. The upper and lower support lugs each have a plurality of radially directed slots cut therein in paired relationship. An axially elongated radially extending diaphragm plate is inserted into each of the paired slots of the upper and lower support lugs and tack-welded into position. A plurality of stay plates are then positioned to extend transversely between adjacent radially extended diaphragm plates and tack-welded into position. Each of the radially extending diaphragm plates is then final welded to both the upper and lower support lugs. Attachment pin holes are then drilled in the upper support lug of the sector shaped subcompartmnt and the upper support plate of the rotor post into which the upper support lug of the sector shaped subcompartment is inserted. The lower support lug rests on a ledge formed on the lower rotor post support plate. The stay plates are then final welded to the diaphragm plates either with the subcompartment mounted to the rotor post, or, preferably, with the subcompartment removed from the post and laid on the floor of the shop. These steps are then repeated to produce as many sector-shaped rotor subcompartments as necessary. Typically, this number will vary from a minimum of four sector-shaped rotor subcompartments for the smaller size heat exchangers up to twelve for larger size heat exchangers. The central rotor post and the plurality of sector-shaped rotor subcompartments are then shipped in a cylindrical rotor assembly of the heat exchanger. Erection in the field merely involves pinning the sector-shaped rotor subcompartment to the rotor post and then welding at the interface of each of the individual sector subcompartments.

Preferably, the individual sector subcompartments are prior to shipment again detachably mounted to the central rotor post and then welded together to form two halves of the rotor compartment for subsequent shipping. The two halves are then removed from the rotor post and shipped with the rotor post in dissassembled state for subsequent field erection. To erect the heat exchanger, each rotor half is pinned to the rotor post and final welds made to connect the two halves together only at the two interfaces thereof thereby minimizing the amount of field welding necessary to construct the final assembly of the heat exchanger.

DESCRIPTION OF THE PREFERRED EMBODIMENT

Figure 1:
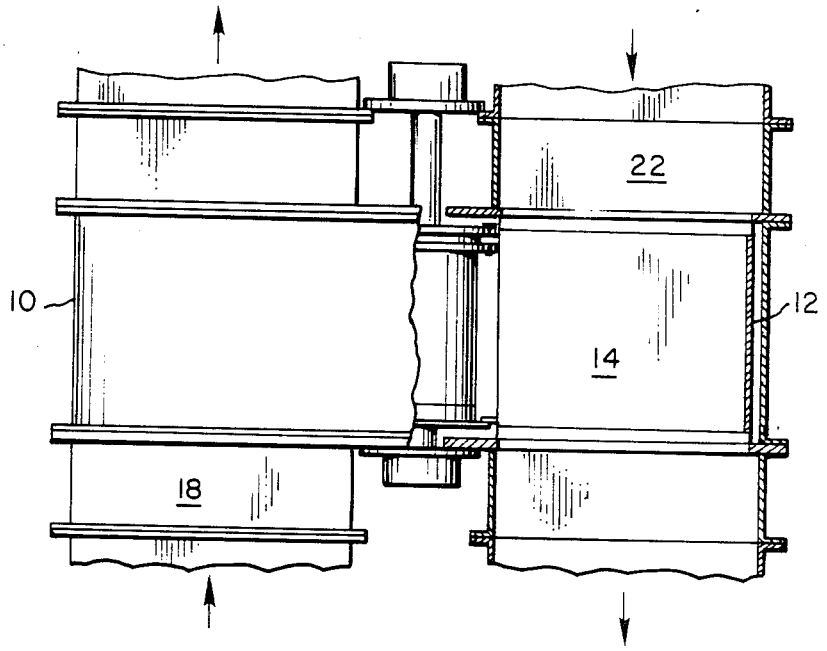
FIG. 1 is an elevational view, partly in section, of a typical rotary regenerative heat exchanger.

Referring now to the drawing, there is depicted in FIG. 1 a rotary regenerative heat exchanger comprising a housing 10 enclosing a rotor 12 wherein a heat transfer material is carried. The rotor 12 comprises a rotor compartment 14 surrounding and mounted to a vertically disposed, rotatable central rotor post 16. A heating gas enters the housing 10 through duct 22 while the gas to be heated enters the housing 10 from the opposite end through duct 18.

The rotor assembly 12 is turned about its axis by a motor connected to the rotor post 16 through suitable reduction gearing, not illustrated here. As the rotor assembly 12 rotates, the heat transfer material carried in the rotor compartment 14 is first moved in contact with the heating gas entering the housing through duct 18 to absorb heat therefrom and then into contact with the gas to be heated entering the housing through duct 22. As the heating gas passes over the heat transfer material, the heat transfer material absorbs heat therefrom. As the gas to be heated subsequently passes over the heated heat transfer material, the fluid absorbs the heat which the material had picked up when in contact with the heating gas.

Figure 2:
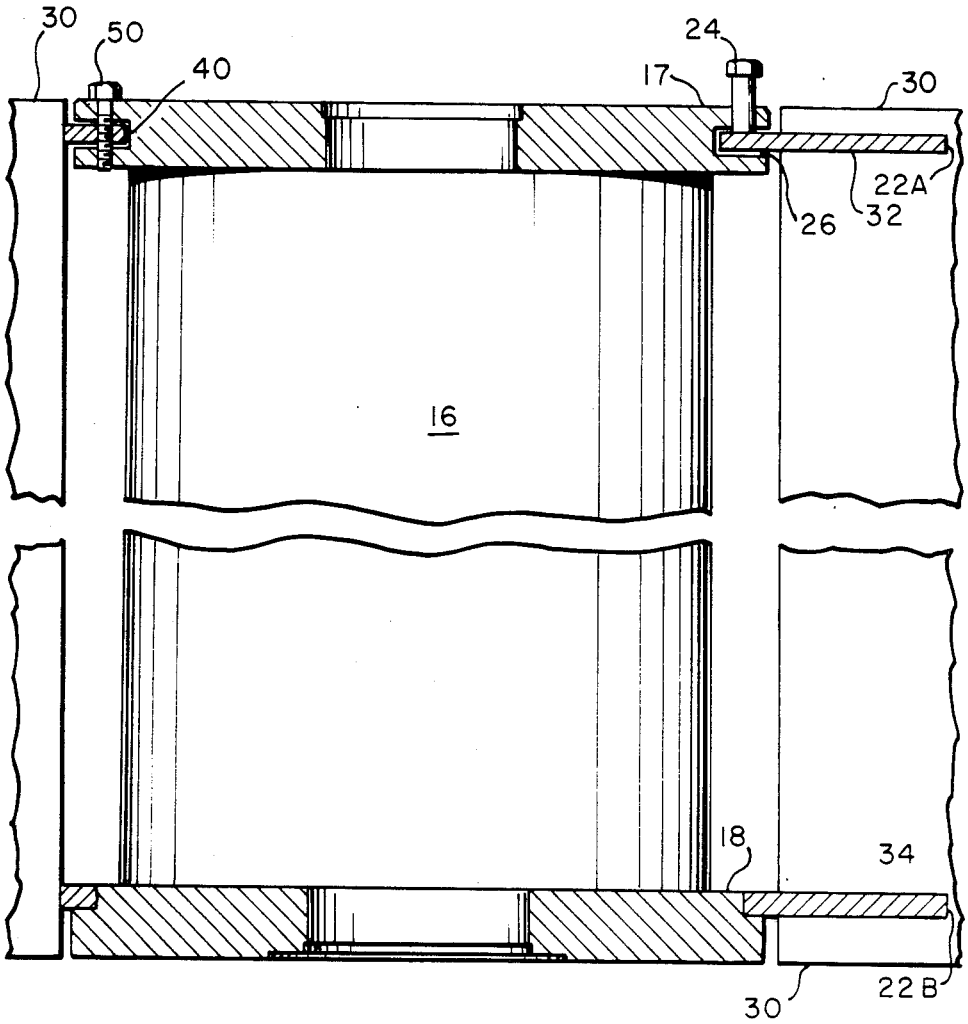
FIG. 2 is an enlarged elevational view, partly in section, depicting the construction of the rotor assembly in accordance with the present invention.
Figure 3:
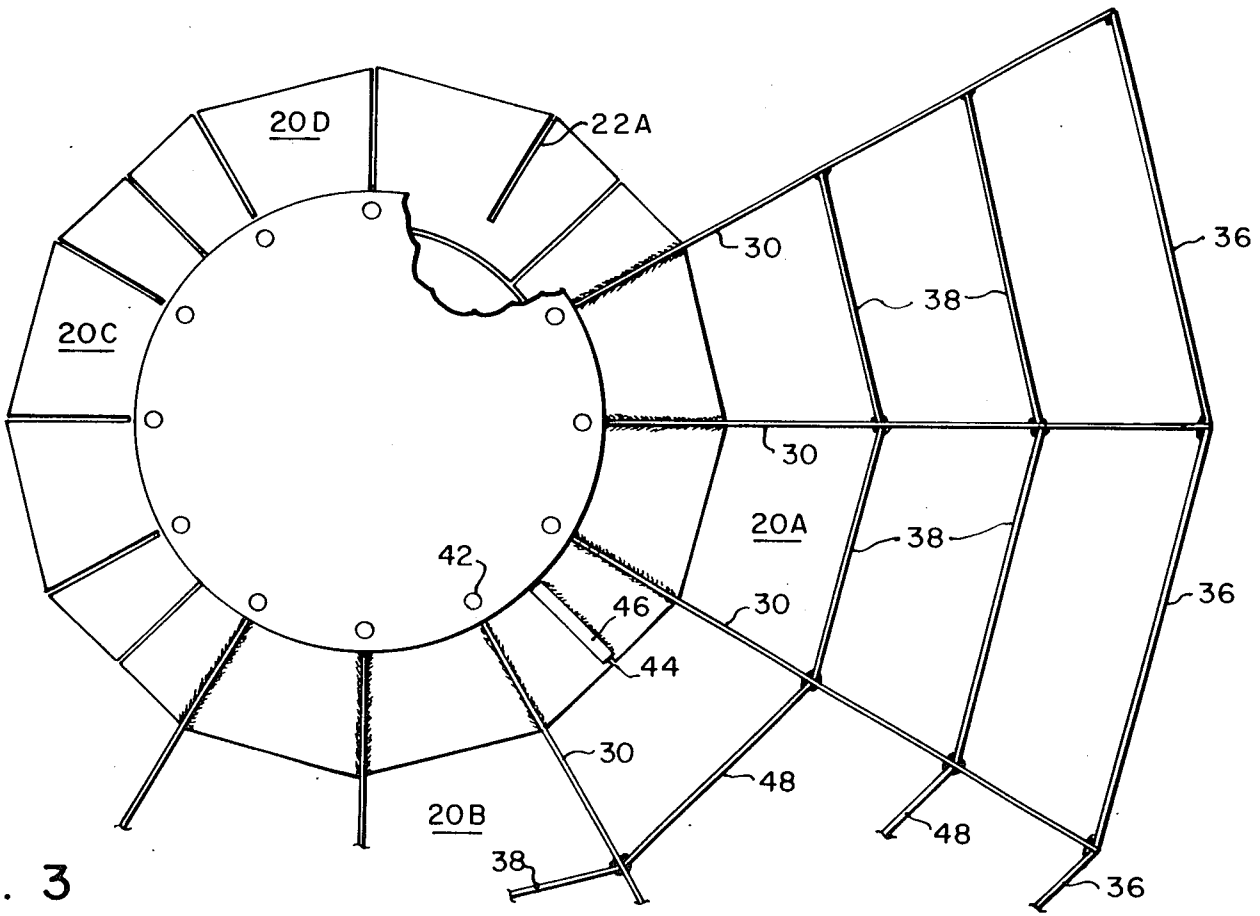
FIG. 3 is a plan view, looking downward, further depicting construction of the rotor assembly in accordance with the present invention.

Referring now to FIGS. 2 and 3, there is depicted therein such a rotary regenerative heat exchanger constructed in accordance with the present invention. As shown therein, the rotor compartment 14 is formed of a plurality of sector-shaped rotor subcompartments 20A, 20B, 20C and 20D disposed about and mounted to the central rotor post 16. Each of the sector-shaped rotor subcompartments comprises at least two axially elongated diaphragm plates 30 which extend radially outward from the rotor post 16 and are connected at their radially inward edge to an upper support lug 32 and a lower support lug 34 and at their radially outward end to a rotor shell plate 36. The upper and lower support lugs 32 and 34 are connected to the rotor post 16 to support the rotor subcompartment therefrom. Stay plates 38, which include basket support means, are interconnected between the diaphragm plates 30 to add structural rigidity through the rotor subcompartment as well as to support baskets of heat transfer material, not shown, within the rotor compartment 14.

To construct the rotor assembly in accordance with the present invention, each of the sector-shaped rotor subcompartments 20A, 20B, 20C amd 20D are constructed independently of each other on the rotor post 16. The rotor post 16 is prefabricated according to conventional techniques and comprises an axially elongated shell having coaxially mounted to the top end thereof and upper post plate 17 and to the bottom thereof a lower post plate 18. The upper post plate 17 and the lower post plate 18 each comprise annular members adapted to receive the upper support lug 32 and the lower support lug 34, respectively, for supporting the sector-shaped rotor subcompartment. The upper post plate 17 has a U-shaped outer circumferential configuration into which the upper support lug 32 is fitted and pinned in tension. The lower post plate 18 is configured to provide an annular shelf upon which the lower support lug 34 is mounted in compression. Alternately, the lower post plate 18 may also be configured to have a U-shaped outer circumferential configuration into which the lower support lug 34 is inserted and pinned. The upper and lower post plates 17 and 18 comprise heavy plate members attached to the axial ends of the rotor post shell to form the rotor post 16.

The rotor post 16 is mounted vertically in a suitable jig to support the rotor post in its proper disposition. Then, the upper support lug 32 is inserted into the upper post plate 17 at the top of the rotor post 16 and detachably clamped into position by means such as clamp bolt 24 and shim 26. Likewise, the lower support lug 34 is fitted to the lower post plate 18 at the bottom of the rotor post 16 and detachably clamped into position. Both the upper support lug 32 and the lower support lug 34 comprise sector-shaped plates which may range from a 30° sector of the cylindrical rotor assembly for large heat exchangers up to a 90° sector of the cylindrical rotor assembly for smaller heat exchangers. Both the upper and lower support lugs 32 and 34 have formed therein a plurality of radially directed slots 22A and 22B which are preferably precision burned into plates. The slots 22A are formed in the upper support lug 32 to be aligned and paired with similar slots 22B formed in the lower support lug 34.

Once the upper support lug 32 and the lower support lug 34 have been detachably mounted to the central rotor post 16 as described above, an axially elongated, radially extended diaphragm plate 30 is inserted into each of the pairs of radially directed slots 22A and 22B formed respectively in the upper and lower support lugs 32 and 34. The radially extending diaphragm plates once properly positioned are then tacked welded to the upper support lug 32 and the lower support lug 34 to hold them in position during the assembly process. At least two diaphragm plates 30, and preferably three, are inserted into the upper and lower support lugs 32 and 34 to form each of the sector-shaped subcompartments 20A, 20B, 20C and 20D.

After the diaphragm plates 30 have been tack-welded into position, a plurality of stay plates 38 and shell plates 36 are positioned to extend transversely between adjacent radially extending diaphragm plates 30 as shown in FIG. 2. Once properly positioned, the stay plates and shell plates are tack welded at their ends to the diaphragm plates 30 so that they remain in position during the remainder of the assembly process. The stay plates 38 not only add structural integrity to the rotor subcompartments, but also provide means for supporting the heat transfer material baskets not shown, which are subsequently placed in the assembled rotor compartment to provide a means for absorbing heat from the hot gas and transferring that heat to the gas to be heated.

With the stay plates 38, shell plates 36 and the diaphragm plates 30, properly positioned and tack welded, the diaphragm plates 30 are finally welded through the upper support lugs 32 at their upper end and the lower support lugs 34 at their lower end thereby forming a rigid framework for the sector-shaped subcompartment 20A still mounted to the central rotor post 16, attachment pin holes 40 are drilled in the upper support plate 32 of the sector-shaped rotor subcompartment 20A.

Preferably, although not necessarily, pilot holes 42 would have been previously drilled in the upper post plate 17 into which the upper support lug 32 is fitted. In drilling the holes 40 in the upper support plate 17, these pilot holes would be enlarged and drilled coincident with the holes 40 in the upper support lug 32 by using the pilot holes as a guide.

After the pin holes 40 have been drilled in the upper post plate 17 of the rotor post 16 and the upper support lug of the rotor subcompartment 20A, the stay plates 38 are finally welded to and between the radially extended diaphragm plates 30 to complete the assembly of the sector-shaped rotor subcompartment 20A. Preferably, the subcompartment 20A is removed from the central rotor post 16, laid on the floor and final welded in the downhand position, although final welds may be made with the subcompartment 20A still mounted on the post 16 for smaller size rotor. Having completely fabricated one sector-shaped rotor subcompartment 20A, the above described procedure for constructing a rotor subcompartment is repeated as required to provide all of the plurality of sector-shaped rotor subcompartments necessary to form the rotor compartment 40. In the heat exchanger illustrated in the drawing, rotor subcompartments 20B, 20C and 20D would now be fabricated in sequence in accordance with the procedure outlined for rotor subcompartment 20A above to form four 90° sector-shaped rotor subcompartments.

With the rotor subcompartments now completely assembled, the individual rotor subcompartments could be shipped along with central rotor post in disassembled state for subsequent field erection to form the cylindrical rotor assembly 12 of the heat exchanger. However, it is preferred that the prefabricated rotor subcompartments be partially assembled in the shop to form larger sector-shaped rotor subcompartments for shipment to avoid as much field welding as possible. The number of sector-shaped rotor subcompartments which are formed from the prefabricated rotor subcompartments is determined by the shipping limitations which restrict the size of a piece of equipment which may be shipped.

To form a larger subcompartment for shipment as illustrated in FIG. 3, two of the sector-shaped rotor subcompartments 20A and 20B are again mounted to the rotor post 16 in a detachable manner to form a 180° sector rotor compartment subassembly. When remounted to the rotor post 16, the lateral edges of the support lugs 32 of the rotor subcompartments 20A and 20B abut in a closely spaced relationship with a gap 44 therebetween. Likewise, the lower support lugs 34 of each of the rotor subcompartments 20A and 20B abut in closely spaced relationship with a gap 44 therebetween. With the rotor subcompartments 20A and 20B mounted to the rotor post 16 in abutting position, a filler bar 46 is welded to one of the abutting lateral edges of the adjacent upper support lugs 32 and the lower support lugs 34 to span and thereby seal the gap 44 between the upper support lug 32 and the lower support lug 34 of each of the rotor subcompartments 20A and 20B while still permitting relative movement therebetween. To complete the assembly of the rotor half sector, stay plates 48 are welded in position to extend transversely between the neighboring diaphragms 30 of the rotor subcompartments 20A and 20B. Preferably, these stay plates 48 would have heen previously welded to extend outwardly from one of either subcompartment **20*a* or 20B** when that subcompartment is prefabricated on a floor of a shop so that the number of welds performed in the downhand position would be maximized and the number of welds formed in the vertical up position, i.e. with the sector subcompartments mounted to the rotor post, minimized.

Once the rotor subcompartments 20A and 20B have been welded together to form a first half of the rotor compartment 14, this first half of the rotor compartment would be removed from the rotor post 16 and set aside for shipping. The remaining two rotor subcompartments 20C and 20D would now be mounted to the rotor post 16 and welded together as described above with reference to rotor subcompartments 20A and 20B to form a second half of the rotor compartment 14. Once completed, the second half of the rotor compartment 14 would be removed from the rotor post 16 and shipped with the first half thereof and the rotor post 16 in a disassembled state for subsequent assembly in the field.

To erect the heat exchanger in the field, the rotor post 16 would be mounted vertically on suitable bearings to support the rotary assembly 12 in its proper disposition. The first and second halves of the rotor compartment 14 would then be mounted to the rotor post 16 by fitting the lower support lug 34 of the compartment halves into the lower post compression plate 18 and inserting the upper support lugs 32 of the rotor compartment halves into the upper post plate 17 of the rotor post 16. Attachment pins 50 would then be inserted into the upper rotor post plate 17 to expand through the attachment pin holes 40 and the upper support lug 32 to hold the rotor compartment halves in position. The rotor compartment halves would then be welded together at their two interfaces in the field to form a structural integral rotor compartment 14. To weld the two rotor compartment halves together, filler bars 46 would be again welded to one of the lateral edges of the abutting upper and lower lugs 32 and 34 to seal the interfaces of the two rotor compartment halves. Additionally, stay plates 48 would be welded in position between the circumferentially outward and neighboring diaphragm plates 30 of each of the two rotor compartment halves. As plates 48 would have already been welded to one of the circumferentially outward diaphragm plates 30 of each of the rotor compartment halves when the rotor compartment half was in the downhand welding position on the floor of the shop to minimize vertical up welding either in the shop or in the field.

We claim:

1. A method of constructing a cylindrical rotor assembly for a rotary regenerative heat exchanger of the type wherein a mass of heat exchange material is housed in a rotor compartment surrounding and mounted to a vertically-disposed rotatable central rotor post, said rotor compartment formed of a plurality of sector-shaped rotor subcompartments disposed about and mounted to said central rotor post, comprising the steps of:

a. detachably mounting to said central rotor post a sector-shaped upper support lug at the top thereof and a sector-shaped lower support lug at the bottom thereof, said upper and lower support lugs each having a plurality of paired radially directed slots formed therein;

b. inserting an axially elongated, radially extending diaphragm plate into each of the paired radially directed slots of said upper and lower support lugs and tack-welded each radially extending diaphragm plate in position;

c. positioning a plurality of stay plates to extend transversely between adjacent radially extending diaphragm plates and tackwelding each stay plate in position;

d. final welding each radially extending diaphragm plate to said upper and lower support lugs thereby forming a sector-shaped rotor subcompartment;

e. with the sector-shaped rotor subcompartment still mounted to said central rotor post, drilling attachment pin holes in said upper support lugs of the sector-shaped rotor subcompartment;

f. final welding said stay plates to and between said radially extending diaphragm plates to complete the assembly of the sectorshaped rotor subcompartment;

g. repeating steps (a) and (f) as required to provide said plurality sector-shaped rotor subcompartments to form said rotor compartment; and h. prior to shipping, disassembling said central rotor post and said plurality of sector-shaped rotor subcompartments for shipment in disassembled state for subsequent field assembly to form said cylindrical rotor assembly.

2. A method as recited in claim 1 further comprising:

a. prior to shipping, detachably mounting one half of said plurality of sector-shaped rotor subcompartments in juxtaposition about said central rotor post with adjacent upper support lugs and adjacent lower support lugs of said sector-shaped rotor subcompartments abutting;

b. welding stay plates between juxtaposed sector-shaped rotor subcompartments to form a first half of said rotor compartment;

c. removing said first half of said rotor compartments from said central rotor post for shipping;

d. repeating steps (a) and (b) to form a second half of said rotor compartment; and e. removing said second half of said rotor compartment from said central rotor post for shipping.

3. A method as recited in claim 1 wherein the step of final welding said stay plates to and between said radially extending diaphragm plates comprises:

a. removing the sector-shaped rotor subcompartment from central rotor post; and b. final welding said stay plates to and between said diaphragm plates with the subcompartment position for welding in the downhand position.

* * * * *